US011549203B2

(12) United States Patent
Nieminen et al.

(10) Patent No.: US 11,549,203 B2
(45) Date of Patent: Jan. 10, 2023

(54) METHOD FOR MANUFACTURING A CUT RESISTANT FABRIC AND A CUT RESISTANT FABRIC

(71) Applicants: SLASHTER OY, Jyväskylä (FI); ORNEULE OY, Orivesi (FI)

(72) Inventors: Toni Nieminen, Jyväskylä (FI); Jyrki Uotila, Orivesi (FI); Timo Uotila, Orivesi (FI)

(73) Assignees: SLASHTER OY, Jyväskylä (FI); ORNEULE OY, Orivesi (FI)

( * ) Notice: Subject to any disclaimer, the term of this patent is extended or adjusted under 35 U.S.C. 154(b) by 814 days.

(21) Appl. No.: 16/432,891

(22) Filed: Jun. 5, 2019

(65) Prior Publication Data

US 2019/0284735 A1 Sep. 19, 2019

Related U.S. Application Data

(63) Continuation-in-part of application No. PCT/FI2017/050873, filed on Dec. 11, 2017.

(30) Foreign Application Priority Data

Dec. 9, 2016 (FI) ..... 20165951

(51) Int. Cl.
*D04B 1/22* (2006.01)
*D04B 9/42* (2006.01)
(Continued)

(52) U.S. Cl.
CPC ..... *D04B 1/18* (2013.01); *D04B 1/16* (2013.01); *D04B 1/24* (2013.01); *D04B 9/42* (2013.01);
(Continued)

(58) Field of Classification Search
None
See application file for complete search history.

(56) References Cited

U.S. PATENT DOCUMENTS 7,943,536 B2 5/2011 D'Ottaviano et al.
2006/0021387 A1 2/2006 Chuang et al.
(Continued)

FOREIGN PATENT DOCUMENTS

WO 2005116316 A1 12/2005
WO 2010089410 A1 8/2010
(Continued)

OTHER PUBLICATIONS

Search Report of Finland Patent Application No. 20165951 dated Jun. 9, 2017.
(Continued)

*Primary Examiner* — Shawn Mckinnon
(74) *Attorney, Agent, or Firm* — FisherBroyles, LLP; Robert Kinberg

(57) ABSTRACT

A method for manufacturing a cut resistant fabric includes: supplying a polyethene yarn with a thickness of 50-225 dtex as a protective yarn through a first yarn carrier of a circular knitting machine to a feeder needle at a first selected tension; supplying simultaneously an uncoated elastane yarn with a thickness of 20-80 dtex as a first additional yarn through a second yarn carrier of the circular knitting machine to the same feeder needle at a second selected tension that is higher than the first selected tension of the protective yarn; forming a fabric from the protective yarn and the first additional yarn as single-jersey knits; and interlocking the protective yarn and the first additional yarn in each single-jersey knit of the fabric using a heat treatment step on a stenter frame.

20 Claims, 6 Drawing Sheets

(51) Int. Cl.
*D04B 1/16* (2006.01)
*D04B 1/18* (2006.01)
*D04B 1/24* (2006.01)

(52) U.S. Cl.
CPC ..... *D04B 1/22* (2013.01); *D10B 2403/0114* (2013.01); *D10B 2501/04* (2013.01)

(56) References Cited

U.S. PATENT DOCUMENTS

| | | | | |
|---|---|---|---|---|
| 2010/0050699 | A1* | 3/2010 | Kolmes ..... | D04B 1/28 66/178 R |
| 2010/0275341 | A1 | 11/2010 | Sweeney et al. | |
| 2012/0122364 | A1 | 5/2012 | Menczywor | |
| 2016/0265146 | A1 | 9/2016 | Liao et al. | |

FOREIGN PATENT DOCUMENTS

| | | | |
|---|---|---|---|
| WO | WO2010089410 | * | 8/2010 |
| WO | 2014134682 | A1 | 9/2014 |

OTHER PUBLICATIONS

International Search Report of PCT/FI2017/050873 dated Mar. 26, 2018.
Written Opinion of PCT/FI2017/050873 dated Mar. 26, 2018.
International Preliminary Report on Patentability of PCT/FI2017/050873 dated Mar. 20, 2019.

* cited by examiner

METHOD FOR MANUFACTURING A CUT RESISTANT FABRIC AND A CUT RESISTANT FABRIC

CROSS-REFERENCE TO RELATED APPLICATIONS

This application is a continuation-in-part application of International Patent Application No. PCT/FI2017/050873, filed Dec. 11, 2017, which claims benefit of Finland Patent Application No. 20165951, filed Dec. 9, 2016, the entire contents of both applications being incorporated herein by reference.

TECHNICAL FIELD

The invention is related to a method for manufacturing a cut resistant fabric, in which method a cut resistant fabric is manufactured according to the following steps:

- supplying protective yarn and first additional yarn to a circular knitting machine for forming a fabric, wherein the first additional yarn is supplied with each protective yarn through the same feeder of the circular knitting machine,
- using polyethene yarn with a thickness of 50-225 dtex, preferably 100-120 dtex, as the protective yarn and uncoated elastane yarn with a thickness of 20-80 dtex, preferably 30-78 dtex, as the first additional yarn,
- forming a fabric from the protective yarn and the first additional yarn supplied as single-jersey knits,
- finishing the fabric in a heat treatment step for stabilising the fabric.

The invention is also related to a cut resistant fabric, particularly a cut resistance fabric meeting the EN388 standard.

BACKGROUND OF THE INVENTION

Leisure time activities and sports often include an element that can produce an incised wound to a person. In ice hockey, for example, a skate of a player can cut an incised wound. To avoid incised wounds, various protective equipment can be used that provide protection against incised wounds. Cut resistance includes several different levels ranging from resistance to chain saws to resistance to a normal knife. The higher the level of the required cut resistance, the thicker are the fabrics needed for cut resistance. Generally, in sports equipment, for example, it has been necessary to use fabrics of a lower cut resistance level, since fabrics with better cut resistance have been truly thick and thereby impractical for sports.

Publication WO 2005/116316 A1 proposes a cut resistant garment, which has been manufactured with a circular knitting machine using the rib knit. Here, the rib knit is used striving to provide an adequately stretchy cut resistant fabric that fits the wearer properly without a separate fastener. Generally, other knit types, such as jersey knits, have been too loose, so that fabric garments made of these have not fitted the wearer properly. In the cut resistant fabric, polyethene yarn with a tenacity of approximately 350-800 dtex and steel yarn have been used in combination to provide cut resistance. However, such a structure is very thick and rigid and is therefore not suitable for applications in which the garment or outfit must be stretchy and thin.

Publication WO 2010/089410 A1 is also known prior art, wherein a cut resistant fabric is formed from protective yarn made of polyethene and additional yarn made of elastane, wrapped around the protective yarn, using single-jersey knits. However, such a fabric is weak regarding its cut resistance and in any event requires that protective yarn and additional yarn are first wrapped around each other.

SUMMARY OF THE INVENTION

An object of the invention is to provide a method better than prior art methods that can be used to manufacture a cut resistant fabric that is thinner and stretchier than heretofore. Another object of the invention is to provide a cut resistant fabric that is thinner and stretchier than prior art cut resistant fabrics meeting, however, sufficient criteria according to the EN388 standard.

The method according to the invention is characterized by a method for manufacturing a cut resistant fabric, in which method a cut resistant fabric is manufactured according to the following steps of supplying a polyethene yarn with a thickness of 50-225 dtex as a protective yarn through a first yarn carrier of a circular knitting machine to a feeder needle at a first selected tension, supplying simultaneously an uncoated elastane yarn with a thickness of 20-80 dtex as a first additional yarn through a second yarn carrier of the circular knitting machine to the same feeder needle at a second selected tension, wherein the second selected tension of the first additional yarn is higher than the first selected tension of the protective yarn and length of the first additional yarn supplied to one machine cycle of the circular knitting machine is between 5% and 25% of length of the machine cycle of the circular knitting machine, forming the cut resistant fabric as a tubular structure from the protective yarn and the first additional yarn as single-jersey knits using the circular knitting machine, cutting the tubular structure in half to form a fabric plane, setting the fabric plane on a stenter frame maintaining the length of the first additional yarn in the fabric and interlocking the protective yarn and the first additional yarn in each single-jersey knit of the cut resistant fabric using a heat treatment step on the stenter frame to stabilize the cut resistant fabric.

In the method according to the invention, polyethene yarn and elastane yarn are supplied parallel with each other to a circular knitting machine at selected tensions so that it is not necessary to wrap polyethene yarn and elastane yarn around each other in a separate step. At the same time, elastane yarn remains in the fabric at a residual tension, which enables the fabric to stretch/recover while simultaneously constricting polyethene yarn. With a heat treatment performed using a stenter frame, elastane yarn and polyethene yarn can be interlocked to form the final fabric. Thus, good cut resistance is achieved with thin polyethene yarn, when there is a large amount of polyethene yarn per unit area and the amount of open space remains small. At the same time, when using thin polyethene yarn, the fabric can be manufactured as notably thin. The fabric is finished in a heat treatment step for stabilising the fabric thus achieving fabric shrinkage, which increases the number of polyethene yarns per unit area and thereby improves cut resistance.

Due to an adequate supply tension, elastane yarn can be supplied as a double-feed in a tensioned state, together with polyethene yarn or second additional yarn, whereat elastane yarn tends to retract to its stable state without an external force, pulling polyethene yarn and possibly also second additional yarn into a dense knit. The supply tension can be measured for example with a "DECOTEX IP" yarn meter manufactured by MEMMINGER-IRO GmbH.

Surprisingly, it has also been noticed that it is possible to use the single-jersey knit, which has been generally considered poor as regards stretch fabrics, when the stretch and cut resistance properties of the fabric are provided through elastane yarn double-fed to a single-jersey knit parallel with protective yarn. Then the polyethene yarn and the elastane yarn can be supplied each at a selected tension, which contributes to providing a stretchy and dense structure for the fabric. In prior art, it has generally been considered that it is necessary to use either the rib knit or the interlock knit as the knit to form a stretchy and cut resistant fabric. In the method according to the invention, a fabric manufactured as single-jersey knits is single-layered and therefore thin. By supplying the protective yarn and the first additional yarn separately to each feeder a particularly good cut resistance is achieved.

In this application, polyethene yarn can also be referred to as polyethylene yarn.

Advantageously, the fabric plane is set on the stenter frame in unstretched state. Stretching of the fabric plane prior stabilization using heat treatment would result partial disintegration of the fabric since the additional yarn would escape from the knits during stretching. Now the fabric can be stabilized maintaining the length of the additional yarn.

Advantageously, the filament count of polyethene yarn ranges between 25 and 200. Thus, polyethene yarn has an adequately great number of individual filaments to provide cut resistance.

By supplying the protective yarn and the first additional yarn separately to each feeder a particularly good cut resistance is achieved.

The temperature of the heat treatment step preferably ranges between 100° C. and 130° C. Thus, the temperature is sufficiently high to provide fabric shrinkage, yet suitably low to ensure that synthetic yarns of the fabric will not begin to deform, in which case the fabric becomes rigid and "paper-like". In other words, the temperature is sufficiently low to prevent the fabric from "burning" on the stenter frame.

The fabric can be finished in a washing step before the heat treatment step. With the washing step, it is possible to remove any impurities in the fabric thus achieving an end product of higher quality. At the same time, the washing temperature partly thermally stabilises the fabric, interlocking the protective yarn and the first additional yarn.

Advantageously, an anti-crease agent is used as a lubricant in the washing step of the method. This prevents generation of creases on the delicate surface of the fabric.

According to an embodiment, second additional yarn is alternately supplied in the method to every second feeder point relative to the protective yarn. In this way, the use of polyethene yarn, which is notably more expensive than elastane yarn, can be reduced with scarcely any loss of fabric properties. Advantageously, the second additional yarn is not cut resistant. Although the amount of polyethene yarn providing cut resistance is half as much in the final fabric, the required cut resistance is achieved as the elastane yarn compresses the polyethene yarn into a dense fabric.

One of the following can be used as the second additional yarn: polyester yarn, polypropylene yarn, polyamide yarn. All of the above-mentioned yarns have a notably lower price than polyethene yarn, thus enabling even a reduction of 25% in the manufacturing costs of the fabric according to the invention.

Advantageously, first additional yarn is also supplied with each second additional yarn through the same feeder of the circular knitting machine as a double-feed. Thus, elastane yarn runs in each stitch of the fabric keeping the stitches of the fabric tight.

A circular knitting machine provided with 20 to 32 needles per inch in the machine cycle is advantageously used for manufacturing the fabric. Sufficiently densely placed needles enable a dense structure to the fabric.

Preferably the tubular structure of the fabric is cut in half before heat treatment step that interlocks yarns together and stabilizes the fabric. This enables the fabric to be treated on a stenter frame as a single layer without stretching the fabric. A fabric with a tubular structure would have to be stretched to make it fit the stenter frame.

The fabric according to the invention is characterized by a cut resistant fabric, comprising protective yarns for providing cut resistance to the fabric, the protective yarns being a polyethene yarn with a thickness of 50-225 dtex, first additional yarns for binding protective yarns together in the fabric, the first additional yarn being an uncoated elastane yarn with a thickness of 20-78 dtex, individual stitches formed from the protective yarns and first additional yarns, each stitch having the protective yarn and the first additional yarn side by side to each other, the stitches forming a single-jersey knit of the fabric, the fabric having plurality of single-jersey knits, wherein the first additional yarns have a residual tension in the fabric, the residual tension being such that the first additional yarns are stretched to length of 110% to 150% of the length of the additional yarn in unstretched state, and length of the fabric in a maximum stretch state of the fabric is 135%-165% of length of the fabric in an unstretched state and the length of the fabric in a use state is stretched by 10%-25% of the length of the fabric in the unstretched state.

The term "residual tension" refers to tension of each yarn in the fabric when the fabric is in its unstretched state.

In the fabric according to the invention, polyethene yarn and elastane yarn are used supplied in parallel with each other without being wrapped around each other; which enables stretch of the fabric while simultaneously constricting polyethene yarn into a dense structure. Thus, good cut resistance is surprisingly achieved with thin polyethene yarn, when there is a large amount of polyethene yarn per unit area and the amount of open space remains small. At the same time, when using thin polyethene yarn, the fabric can be manufactured as notably thin.

According to an embodiment, the fabric includes second additional yarn, which is in every other stitch instead of protective yarn. The use of second additional yarn reduces manufacturing costs of the fabric, since the second additional yarn is not cut resistant and is therefore less expensive than polyethene yarn.

Advantageously, first additional yarn runs parallel with the second additional yarn as a double yarn. Thus, the first additional yarn, or elastane yarn, runs through each stitch in the fabric enabling its uniform stretch and cut resistance.

The second additional yarn can be one of the following: polyester yarn, polypropylene yarn, polyamide yarn. All of the above-mentioned yarns are less expensive than polyethene yarn and thus optimal for replacing expensive polyethene yarn.

Advantageously, the abrasion resistance, cut resistance and tear resistance values of the fabric are each at least 2 according to the EN388 standard. Then the fabric can be used in a versatile manner for various applications.

The protective yarn is advantageously polyethene yarn marketed under the trademark Dyneema and the first additional yarn is elastane yarn marketed under the trademark Lycra. These yarns are generally known and products that are readily available on the market; therefore, their availability is good.

According to an embodiment, the fabric has 15 to 40, preferably 25 to 30 stitches per inch. An adequately great number of stitches in a certain unit area directly correlates with the cut resistance level, with the fabric being extremely dense, yet simultaneously stretchy.

The basis weight of a fabric according to the invention may range between 150 and 250 g/m$^2$, preferably between 180 and 220 g/m$^2$.

Advantageously, the tension of the first additional yarn in the fabric is such that the first additional yarn is stretched to a length of 160% to 250% relative to unstretched first additional yarn of a corresponding length. Thus, a sufficient residual tension remains in the first additional yarn even after the heat treatment carried out on the stenter frame.

Advantageously, the fabric only includes single-jersey knits that are identical to each other. In this case, the fabric can be made at a sufficient speed using prior art circular knitting machines.

Advantageously, protective yarn and first additional yarn of the fabric are interlocked in the single-jersey knit by help of a heat treatment performed on the stenter frame. Thus, the fabric is dimensionally stable in use and does not notably stretch during washes.

Advantageously, the fabric shrinkage is between 4% and 8% after the heat treatment. This means that when washing a product made from the fabric, no significant shrinkage nor stretching takes place, which is important regarding the usability of the product.

Advantageously, the first additional yarn is 100% elastane. In this case, the first additional yarn resists to the tension applied to it during feeding without breaking unlike other yarns which are coated with materials with weaker stretch properties.

Advantageously, the fabric according to the invention is arranged to achieve a cut resistance level in accordance with the above-mentioned standard for cut resistance when it is single-layered.

Advantageously, a single-jersey fabric is formed from cover yarn and first additional yarn, wherein particularly the protective yarn is in each stitch parallel with the first additional yarn, and said first additional yarn has a residual tension in the fabric when the first additional yarn is stretched by 10% to 50%, preferably by 20% to 30%, and whereat the maximum stretch of the fabric is 50%, generally between 35% and 65%, most preferably between 45% and 55%, and furthermore, whereat stretch comfortable during use is 15%, generally between 10% and 25%, most preferably between 12% and 20%. The term "maximum stretch" refers to maximum stretch of the fabric without causing any permanent changes or damage to the yarns of the fibre. In other words the term "maximum stretch" refers to upper limit of the elasticity of the fabric.

Here, stretch is determined by the maximum compressibility specified in standards. Excessive tightness causes physiological harm.

In this context the unstretched state of the fabric refers to a state wherein the fabric is not subjected to any external force. The elasticity of the fabric is greater in direction of weft than in direction of warp.

Application possibilities of products that are made from a thin fabric are wide, since a thin fabric does not disturb the wearer, it is stretchy and properly fits on the user.

BRIEF DESCRIPTION OF THE DRAWINGS

The invention is described below in detail by making reference to the appended drawings that illustrate some of the embodiments of the invention, in which.

DETAILED DESCRIPTION OF THE INVENTION

Figure 1A:
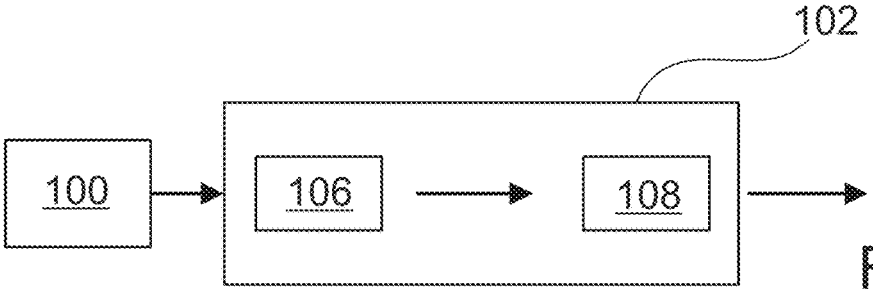
FIG. 1*a* shows block diagrams illustrating an apparatus that is suitable for implementing the method according to the invention.

The method according to the invention can be implemented with the apparatus according to FIG. 1*a* including a circular knitting machine 100 and preferably processing equipment 102. For example, the circular knitting machine 100 can be a prior art circular knitting machine similar to that illustrated in FIGS. 1*a* and 1*b*, into which yarns are supplied from bobbins 104. According to prior art, a circular knitting machine forms knits 18 according to FIGS. 4*b*-4*d*, which in this case are single-jersey knits, from yarns using needles 111 shown in FIG. 5. For example, the circular knitting machine can be a circular knitting machine made by German Terrot GmbH or Mayer&Cie GmbH&Co, having 20-32, preferably 24-28 needles per inch. The diameter of the circular knitting machine can range between 1000 and 2000 mm, for example.

Figure 1B:
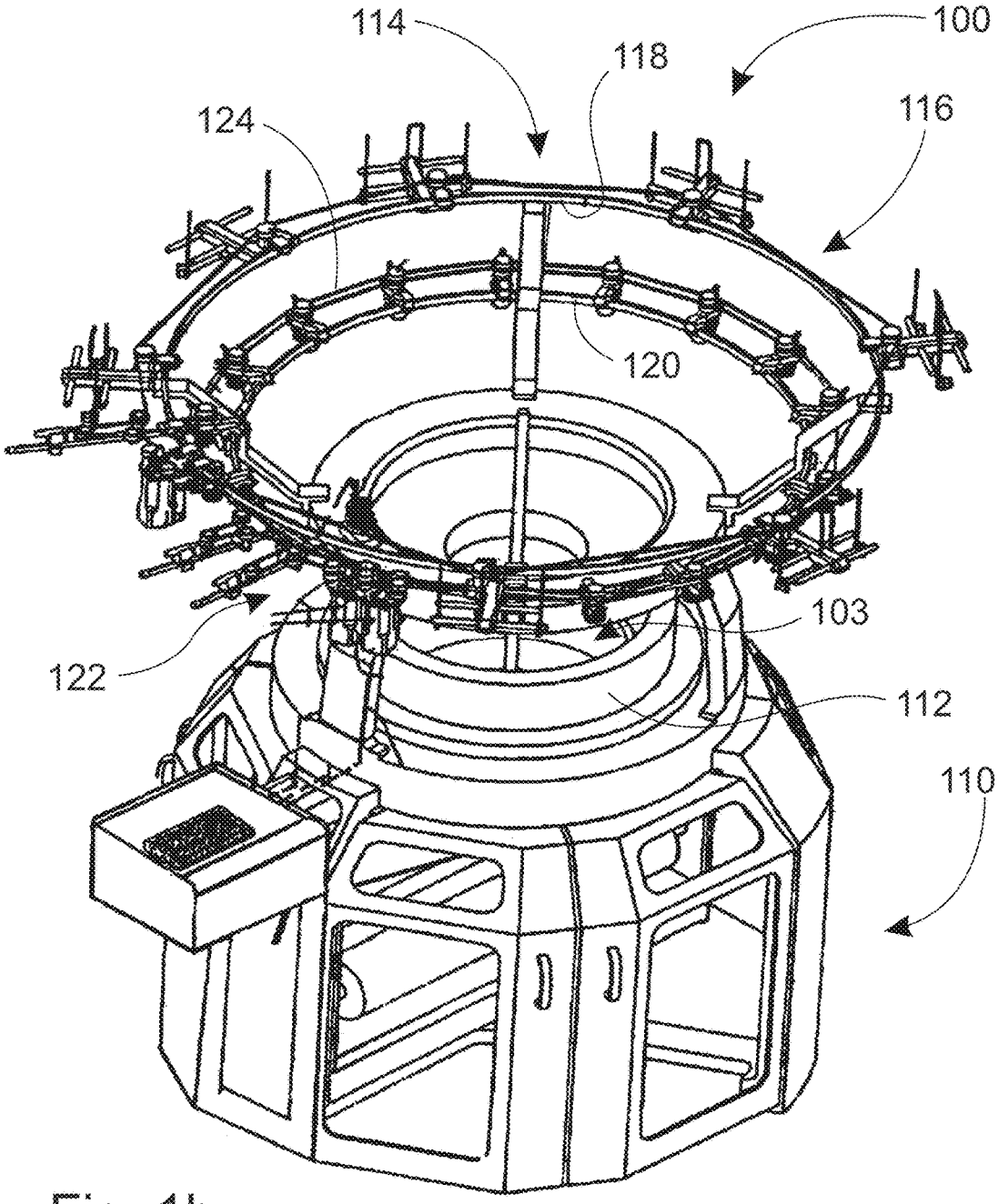
FIG. 1*b* is an axonometric basic view of a circular knitting machine that can be used in the method according to the invention.
Figure 1C:
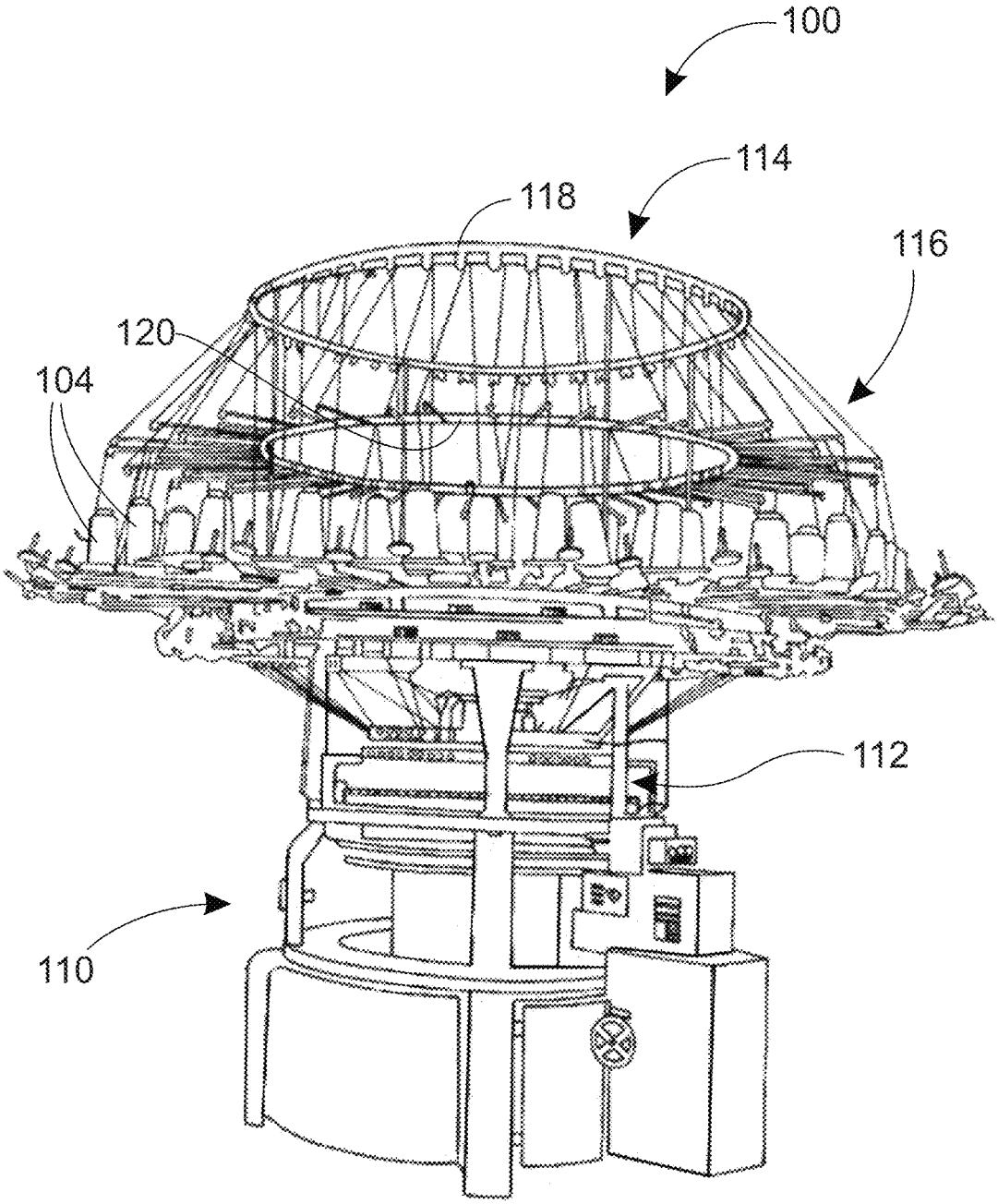
FIG. 1*c* is an axonometric basic view of another circular knitting machine that can be used in the method according to the invention.

More precisely, prior art circular knitting machines 100 illustrated in FIGS. 1*b* and 1*c* include a multi-angle frame 110 fitted against a base, a needle cylinder 112 containing needles arranged on top of the frame 110 and further, a creel arrangement 114 for feed devices arranged on top of the needle cylinder 112. In addition, the circular knitting machine 100 includes several yarn feed devices 116 forming individual feeders 103 according to FIG. 5, suspended in supporting rings 118 and 120 included in the creel arrangement 114 for supplying the yarn 104. The yarn feed devices 116 are driven by at least one motor 122 via power transmission means 124. In this context, when speaking of guiding of yarns to a feeder of the circular knitting machine, guiding of yarns to the same needle using separate yarn carriers is meant.

Figure 2:
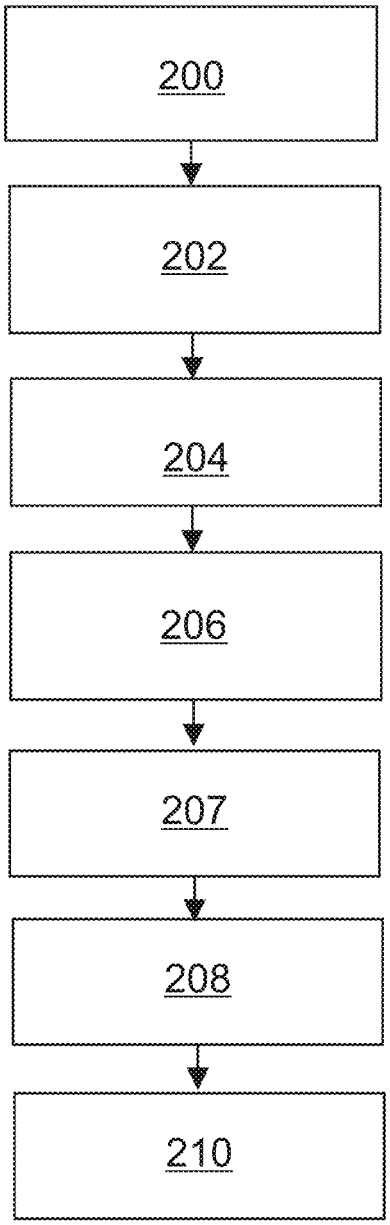
FIG. 2 shows block diagrams illustrating the steps of the method according to the invention.

As shown in FIG. 2, the fabric according to the invention is manufactured with the method for manufacturing a cut resistant fabric, wherein, in step 200, polyethene yarn with a thickness of 50-130 dtex, preferably 100-120 dtex, is supplied to the circular knitting machine as protective yarn and, in step 202, elastane yarn with a thickness of 20-80 dtex, preferably 30-50 dtex, is supplied to the circular knitting machine as first additional yarn in such a way that the first additional yarn is supplied parallel with each protective yarn through the same feeder of the circular knitting machine to the needles, both at their own tension. The fabric is formed from the protective yarn and the first additional yarn supplied as a single-jersey knit in step 204. In this context, double-feeding more precisely means that first additional yarn is also always supplied to the needles parallel with the protective yarn through each feeder of the circular knitting machine. In the method, a part can also be replaced, preferably every other protective yarn, with second additional yarn having more affordable investment costs. For example, the second additional yarn can be polyester yarn, which has notably lower investment costs compared to the price of corresponding polyethene yarn. Correspondingly, other additional yarns can also be used, but the minimum amount of protective yarn is in any case at least 40% and at most 95% by weight of the total weight of the fabric.

The tension applied in supplying the first additional yarn is between 5% and 25%, preferably between 10% and 15% for each machine cycle relative to the length of the machine cycle. In other words, the first additional yarn is supplied under tension, whereat the first additional yarn is stretched. When the first additional yarn runs through the circular knitting machine together with the protective yarn, the tension force acting on the first additional yarn of the yarn feed devices of the circular knitting machine can be partly released, whereat the first additional yarn can partly recover towards its unstretched dimension. Thus, in a fabric according to the invention, the first additional yarn tightens the protective yarn forming a dense and cut resistant fabric. The first additional yarn has a residual tension in the fabric when the first additional yarn is stretched by 10% to 50%, preferably by 20% to 30%, in the final fabric after the heat treatment.

Advantageously, when using Dyneema yarn, for instance, as the cover yarn, the supply length of protective yarn for a machine cycle of 2.8 m is 7.63 m, whereas, for a Lycra yarn used as the first additional yarn, the supply length is 5.55 m. Thus, the tension of both yarns may be 4 cN-6 cN, preferably 4.5 cN-5.5 cN. According to FIG. 5, both the protective yarn 12 and the first additional yarn 14 are supplied each through its own yarn carrier 125 in the feeder 103; that is, for example, the protective yarn 12 through the opening 128 and the first additional yarn 14 through the feed wheel 130 and the slot 126 to the same needle 111. When supplied through separate yarn carriers 125, both the protective yarn 12 and the first additional yarn 14 have their own tensions, as the tighter yarn does not pull the looser yarn in the same yarn carrier. In other words, adjustment of yarn tensions can be performed notably accurately in the method.

According to an embodiment the diameter of the circular knitting machine is 71 cm, and the length of the machine cycle is 224 cm. In this embodiment 800 cm of protective yarn is fed for each machine cycle and 280 cm of first additional yarn.

The fabric produced with the circular knitting machine is in the form of a tube. Before any heat treatment of the fabric the tubular structure of the fabric is cut in half in step 206 of FIG. 2 to form a fabric plane. This enables the fabric to be set on a stenter frame as a fabric plane without stretching the fabric in step 207.

Advantageously, the post-processing equipment 102 of FIG. 1*a* used for fabric finishing includes a washing machine 106 and a stenter frame 108. In the washing machine, the fabric manufactured with the circular knitting machine is washed in step 208 of FIG. 2 using chemicals for washing, which are manufactured, for example, by a Dutch company Tanatex Chemicals B.V. The purpose of washing is to remove impurities from the fabric and stabilise the fabric. The temperature used in washing may range, for example, between 40° C. and 80° C., preferably between 50° C. and 70° C. An anti-crease agent for synthetic materials, which is a lubricant, is advantageously used during washing. The purpose of the lubricant is to prevent fabric abrasion during washing.

The purpose of the stenter frame is to heat up the fabric to a sufficiently high temperature in step 210, whereat the fabric shrinks and the fabric stabilises regarding its dimensions. The washing machine and the stenter frame can be prior art equipment. For example, the washing machine manufacturer can be SOL and the stenter frame manufacturer can be Brückner Trockentechnik GmbH & Co. KG. The temperature in the heat treatment step advantageously ranges between 100° C. and 150° C. In addition to the washing and heat treatment, finishing may also include other steps, such as a stretch treatment, with which it is attempted to influence end product properties.

Figure 3A:
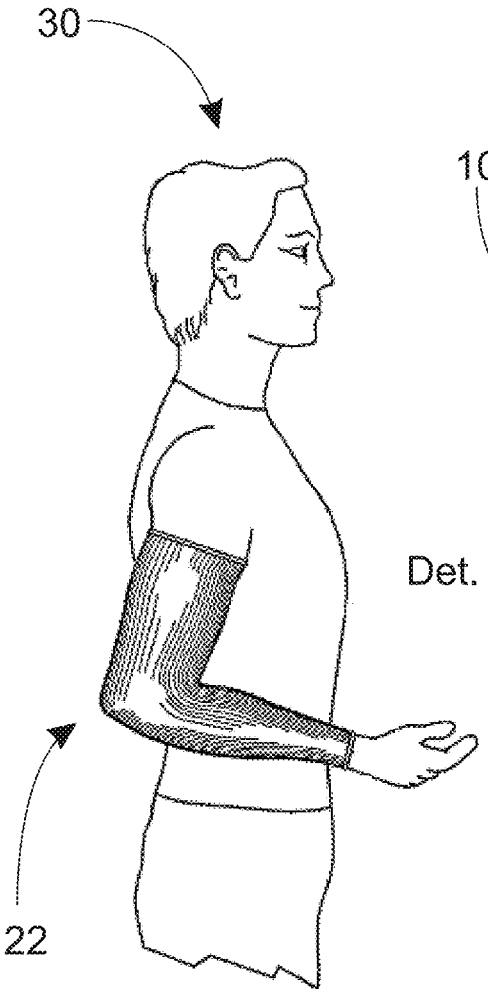
FIG. 3*a* illustrates a garment formed from a fabric according to the invention worn by a user.

From a fabric according to the invention manufactured with a method according to the invention, it is possible to manufacture several different products, in which cut resistance is particularly relevant. FIG. 3*a* shows one such product put on a wearer 30 representing a cut resistant sleeve 22, which is useful, for example, in car mechanic jobs. Car mechanics must put their hands in many places lacking a direct sight, thus exposing their hands to incised wounds and burns.

Figure 4A:
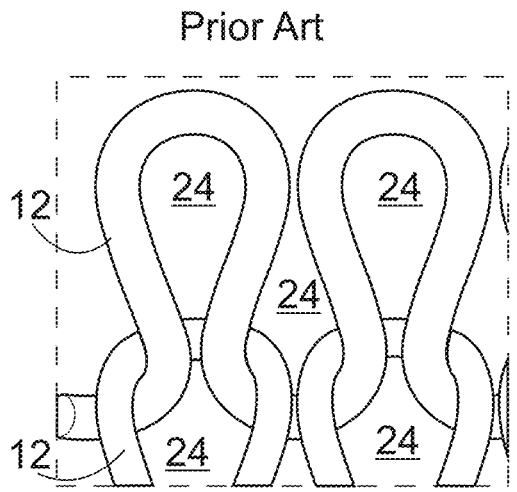
FIG. 4*a* is an enlarged view of a prior art single-jersey knit.

FIG. 4*a* shows an enlargement of a prior art fabric. According to the figure, the single-jersey knit has traditionally been poorly suited to cut resistant fabrics 10, since a very large open area 24 remains between the stitches 16. Thus, per unit area, the single-jersey knit 18 has a notably small amount of protective yarn 12, which provides cut resistance for the fabric 10. This defect can be compensated by increasing the thickness of protective yarn, but then the fabric becomes thick and its stretch and usability suffer.

Figure 3B:
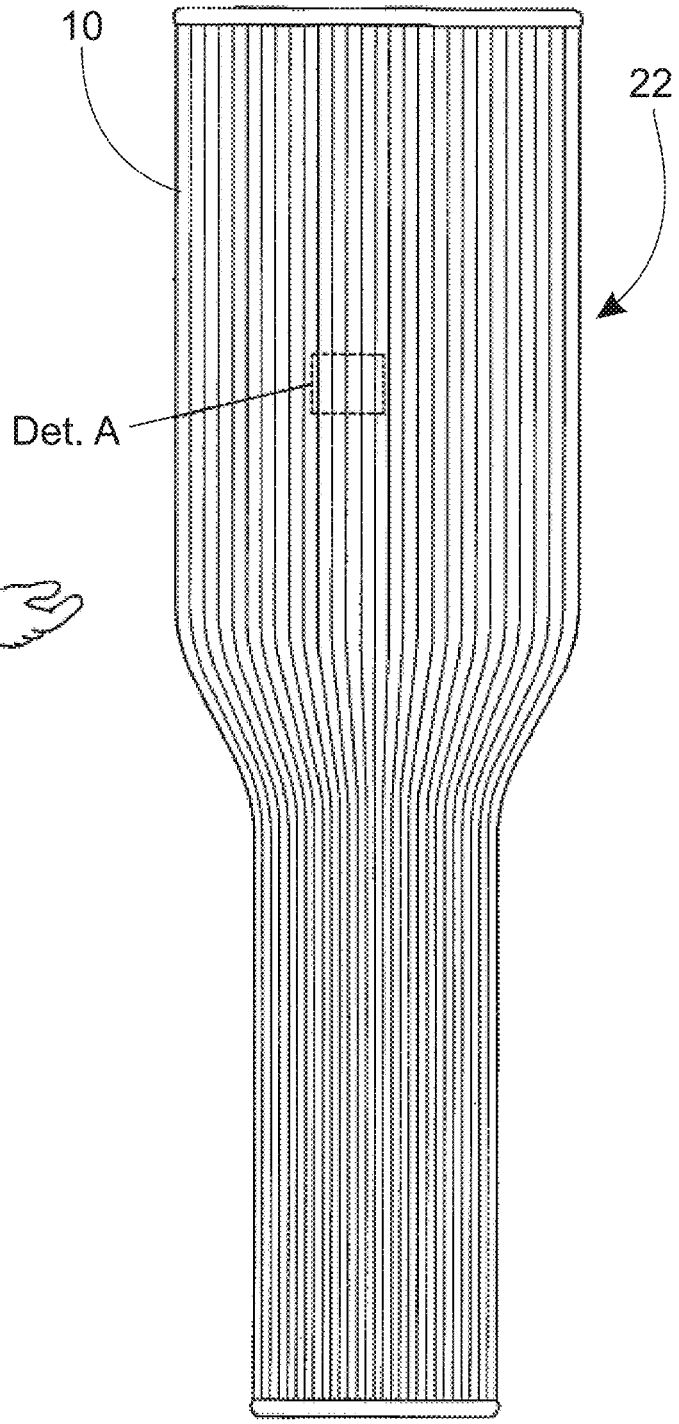
FIG. 3*b* illustrates a garment formed from a fabric according to the invention separately.
Figure 4B:
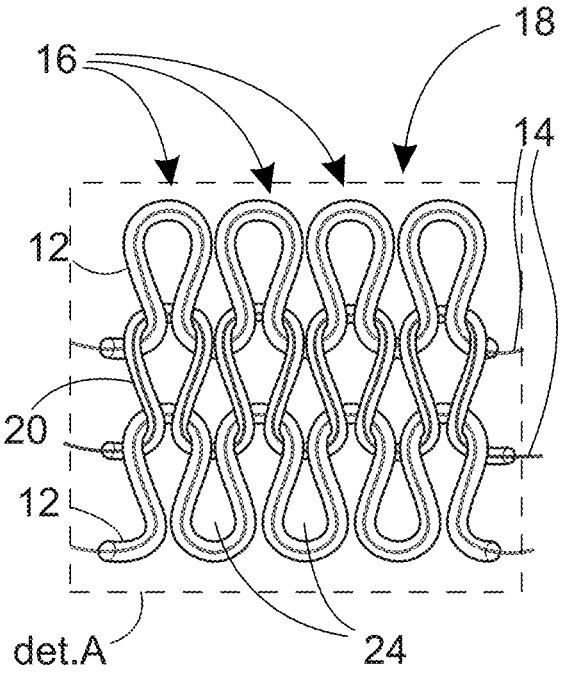
FIG. 4*b* is an enlarged view of detail A of the enlargement of the fabric of FIG. 3.
Figure 4C:
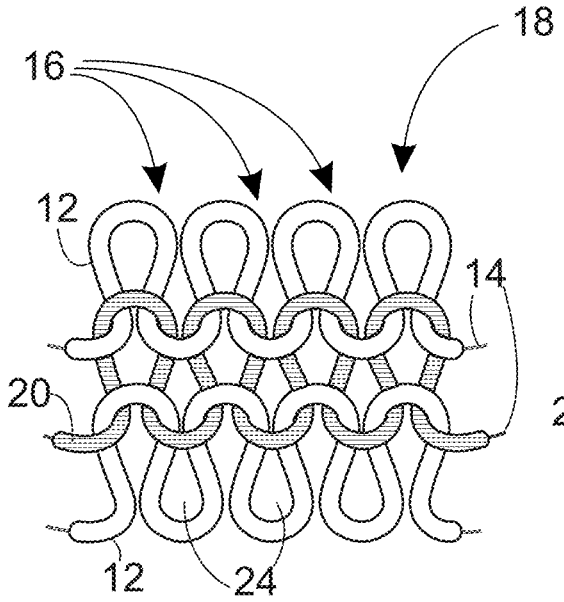
FIG. 4*c* is a rear view of the enlargement of FIG. 4*a*.
Figure 4D:
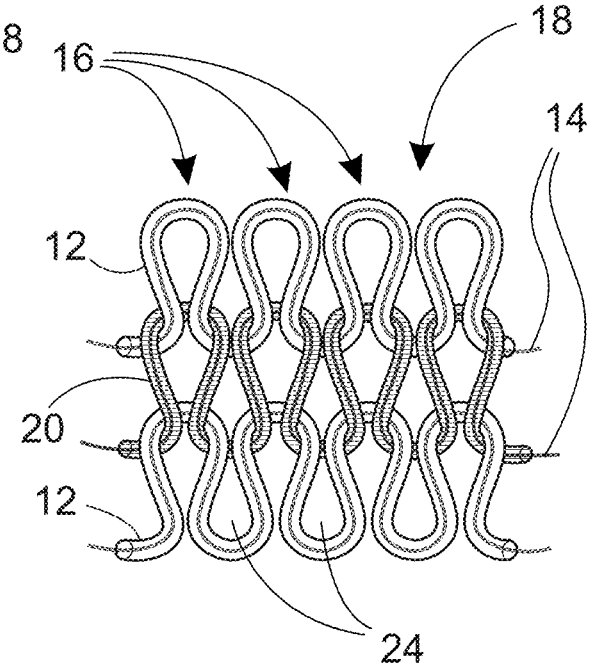
FIG. 4*d* is an enlarged view of a fabric according to another embodiment.
Figure 5:
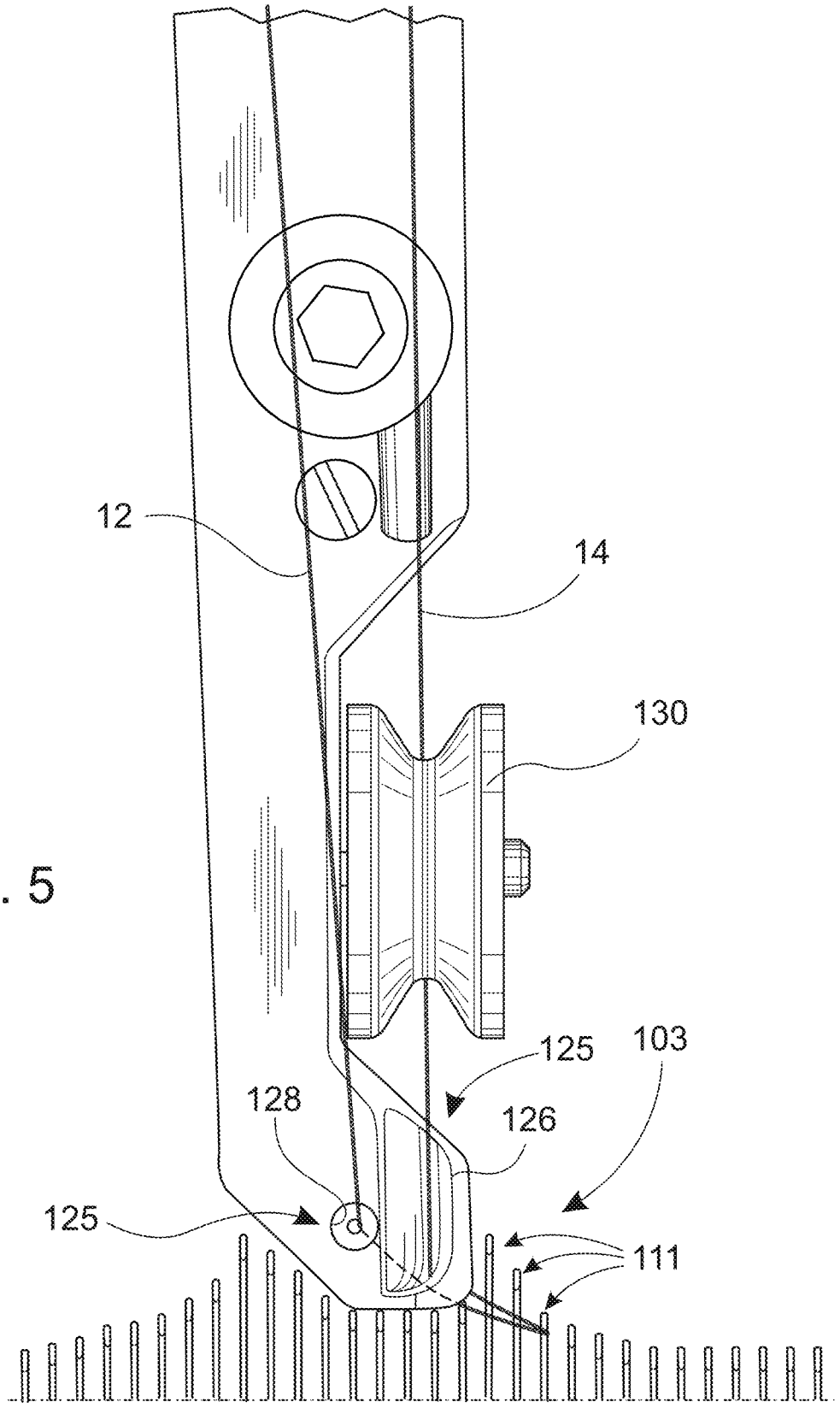
FIG. 5 illustrates the supply of protective yarn and first additional yarn separately to the same feeder of a circular knitting machine.

According to FIG. 3*b*, the situation is different in the fabric 10 according to the invention, since, thanks to its elasticity, the first additional yarn 14, or elastane yarn, simultaneously supplied with each protective yarn 12 pulls the stitches 16 in the fabric 10 notably close to each other, whereat the amount of protective yarn 12 per unit area remarkably increases and the open area 24 remains small. In turn, FIG. 4*c* is a rear view of the same fabric 10 according to the invention, wherein the stitches 16 look slightly different compared to the front view. It is essential that the protective yarn and the first additional yarn are not wrapped around each other before the supply to the needle so that both yarns can be supplied at a selected tension. In other words, the protective yarn and the first additional yarn run parallel to each other to each needle and through each knit of the fabric, as shown in FIGS. 4*b*-4*d*.

Polyethene yarn used as the protective yarn in the method and fabric according to the invention may be polyethene yarn known under the tradename Dyneema with a thickness of 50-225 dtex, preferably 100-120 dtex. In turn, as the first additional yarn, elastane yarn known under the tradename Lycra can be used, its thickness ranging from 20 to 80 dtex, preferably from 30 to 50 dtex. The first additional yarn is advantageously 100% elastane yarn to ensure that the first additional yarn can be supplied sufficiently stretched at the right tension. The thickness of the second additional yarn partially replacing the polyethene yarn can also be between 50 and 130 dtex, preferably between 100 and 120 dtex. FIG.

4*d* illustrates a second embodiment of the fabric according to the invention, wherein second additional yarn 20 has been supplied to every other needle to partly replace protective yarn 12. In association with second additional yarn 20, first additional yarn is also supplied as a double-feed parallel to the second additional yarn 20. When using replacing second additional yarn in every other needle, almost the same level of cut resistance is achieved; however, tear resistance of the fabric notably reduces in this case. Elastane yarn used in a fabric according to the invention must have such properties that it enables the supply to the circular knitting machine at the above-mentioned tension and, in addition, recovers from the stretched state to its original length without permanent deformation.

With a cut resistant fabric according to the invention, the following resistance values are achieved in tests according to the EN388 standard, when the fabric only included polyethene yarn as protective yarn and elastane yarn as first additional yarn. Regarding abrasion, the value of the resistance level is 3 on a scale of 1-4, the tear resistance value is 4 on a scale of 1-4, and the cut resistance value is 2 on a scale of 1-5. When part of polyethene yarn is replaced with second additional yarn, the tear resistance value drops from 4 to 2. If necessary, cut resistance or tear resistance can be increased by using a fabric according to the invention folded over, since the thin structure of the fabric yarn according to the invention enables the manufacture of a stretchy garment even with the fabric folded over. Products requiring greater cut resistance may be, for example, neck protections and similar.

It is surprising that the fabric according to the invention achieves quite high, even excellent values in tests according to the EN388 standard for tear resistance, for example, since the thicknesses of protective yarns and first additional yarns used are less than half of what has been generally used in prior art applications requiring cut resistance. However, a double-feed of the first elastic additional yarn generates forces that pull protective yarns towards each other forming a dense net of protective yarns.

From the fabric according to the invention, it is possible to manufacture garments for several different applications. Applications of the fabric according to the invention can include garments related to occupational safety and health for public and security services, garments for pet care, working clothes and sports clothes. A high degree of elasticity, thin structure and cut resistance of the fabric according to the invention enable the use of the fabric in protective underwear, for example. Particularly advantageous applications include cut resistant equipment for athletes, such as socks for ice hockey players and figure skaters and other wrist and ankle protections, serving the purpose of preventing cuts produced by skate blades during games.

A fabric manufactured with a circular knitting machine comes from the circular knitting machine as a finished tubular structure, which is cut half into a plane form depending on the application. In the fabric, all knits advantageously have an identical structure, which facilitates the manufacture of the fabric.

The invention claimed is:

1. A method for manufacturing a cut resistant fabric, comprising the steps of:

supplying a polyethene yarn with a thickness of 50-225 dtex as a protective yarn through a first yarn carrier of a circular knitting machine to a feeder needle at a first selected tension;

supplying simultaneously an uncoated elastane yarn with a thickness of 20-80 dtex as a first additional yarn through a second yarn carrier of the circular knitting machine to the same feeder needle at a second selected tension, wherein the second selected tension of the first additional yarn is higher than the first selected tension of the protective yarn and a length of the first additional yarn supplied to one machine cycle of the circular knitting machine is between 5% and 25% of a length of the one machine cycle of the circular knitting machine, forming the cut resistant fabric as a tubular structure from the protective yarn and the first additional yarn as single-jersey knits using the circular knitting machine;

cutting the tubular structure in half to form a fabric plane;

setting the fabric plane on a stenter frame maintaining the length of the first additional yarn in the fabric;

interlocking the protective yarn and the first additional yarn in each single-jersey knit of the cut resistant fabric using a heat treatment step on the stenter frame to stabilize the cut resistant fabric.

2. The method according to claim 1, including using a polyethene yarn with a thickness of 100-120 dtex as the protective yarn and using an uncoated elastane yarn with a thickness of 30-78 dtex is used as the first additional yarn.

3. The method according to claim 1, wherein a temperature of the heat treatment step is between 100° C. to 150° C.

4. The method according to claim 1, including supplying a second additional yarn to every second first feeder instead of the protective yarn.

5. The method according to claim 1, wherein the second selected tension is such that length of the first additional yarn supplied to one machine cycle of the circular knitting machine is between 10% and 15% of a length of the one machine cycle of the circular knitting machine.

6. The method according to claim 1, including washing the fabric before the heat treatment.

7. The method according to claim 6, including using an anti-crease agent as a lubricant in washing.

8. A cut resistant fabric, comprising:

protective yarns for providing cut resistance to the fabric, the protective yarns being a polyethene yarn with a thickness of 50-225 dtex; and first additional yarns for binding protective yarns together in the fabric, the first additional yarn comprising an uncoated elastane yarn with a thickness of 20-78 dtex;

wherein individual stitches are formed from the protective yarns and first additional yarns, each stitch having the protective yarn and the first additional yarn extending parallel to each other and being interlocked with each other, the stitches forming a single-jersey knit of the fabric, the fabric having a plurality of single-jersey knits, wherein the first additional yarns, when interlocked with the parallel extending protective yarns, have a residual tension in the fabric resulting from the first additional yarns having been stretched, prior to being interlocked, to a length of 110% to 150% of a length of the first additional yarn in an unstretched state of the first additional yarn, a length of the fabric in a maximum stretch state of the fabric is 135%-165% of length of the fabric in an unstretched state and a length of the fabric in a use state is stretched by 10%-25% of a length of the fabric in the unstretched state.

9. The fabric according to claim 8, wherein the protective yarn is a polyethene yarn with a thickness of 100-120 dtex.

10. The fabric according to claim 8, wherein the first additional yarn is an uncoated elastane yarn with a thickness of 30-50 dtex.

11. The fabric according to claim 8, wherein the residual tension is such that the first additional yarns are stretched to length of 120% to 130% of the length of the additional yarn in unstretched state.

12. The fabric according to claim 8, wherein abrasion resistance, cut resistance and tear resistance of the fabric each have a value of 2-5 according to the EN388 standard.

13. The fabric according to claim 8, wherein a second tension of the first additional yarn in the fabric is such that the first additional yarn is stretched to a length of 160%-250% relative to an unstretched first additional yarn of a corresponding length.

14. The fabric according to claim 8, wherein the fabric comprises only single-jersey knits that are identical to each other.

15. The fabric according to claim 8, wherein a basis weight of the fabric ranges between 180 and 220 g/m2.

16. The fabric according to claim 8, wherein the protective yarn and first additional yarn of each single-jersey knit of the fabric are interlocked by a heat treatment.

17. The fabric according to claim 16, wherein a length of the fabric after the heat treatment is 92-96% of a length of the fabric before heat treatment, shrinkage of fabric being 4-8%.

18. The fabric according to claim 8, wherein the fabric has 25 to 30 stitches per inch.

19. The fabric according to claim 8, wherein the first additional yarn is 100% elastane.

20. The fabric according to claim 8, wherein the fabric meets requirements of the EN388 standard regarding cut resistance.

* * * * *